US006273642B1

(12) United States Patent
Anderson

(10) Patent No.: US 6,273,642 B1
(45) Date of Patent: Aug. 14, 2001

(54) BUOYANT PROPULSION UNDERWATER TRENCHING APPARATUS

(76) Inventor: Richard A. Anderson, 511 Bellevue Plantation, Lafayette, LA (US) 70503

( * ) Notice: Subject to any disclaimer, the term of this patent is extended or adjusted under 35 U.S.C. 154(b) by 0 days.

(21) Appl. No.: 09/359,346

(22) Filed: Jul. 21, 1999

(51) Int. Cl.[7] ..... E02F 3/04
(52) U.S. Cl. ..... 405/163
(58) Field of Search ..... 405/136, 158, 405/159, 161, 162, 163, 160, 164; 37/307, 313, 344, 345, 337–342, 322, 347, 323, 352

(56) References Cited

U.S. PATENT DOCUMENTS

| | | | |
|---|---|---|---|
| 3,576,111 | 4/1971 | Henry . | |
| 3,702,597 | 11/1972 | Odum et al. | 114/16.8 |
| 3,877,237 | 4/1975 | Norman . | |
| 3,926,003 | 12/1975 | Norman . | |
| 4,087,981 | 5/1978 | Norman . | |
| 4,185,580 | 1/1980 | Pujol et al. | 114/321 |
| 4,274,760 | 6/1981 | Norman | 405/163 |
| 4,389,139 | 6/1983 | Norman | 405/163 |
| 4,516,880 | 5/1985 | Martin | 405/160 |
| 4,714,378 | 12/1987 | Lincoln | 405/163 |
| 4,808,037 | 2/1989 | Wade et al. | 405/226 |
| 4,812,079 | 3/1989 | Johnson et al. | 405/164 |
| 5,288,172 | 2/1994 | Reuhl | 405/163 |
| 5,456,551 | 10/1995 | Saxon | 405/163 |
| 5,573,353 | 11/1996 | Recalde | 405/168.3 |
| 5,639,185 | 6/1997 | Saxon | 405/163 |
| 6,022,173 * | 2/2000 | Saxon | 405/163 |

* cited by examiner

*Primary Examiner*—Robert E. Pezzuto
(74) *Attorney, Agent, or Firm*—Lalos & Keegan

(57) ABSTRACT

An underwater self-propelled trenching apparatus for burying a pipeline or the like below the bottom of a body of water having a frame that is positioned on each side of the pipeline, jets in the form of nozzles that spray pressurized streams of water to dig the trench, a set of rollers supported on the apparatus for contacting the pipeline and guiding the apparatus along the pipeline and a plurality of thrusters pivotally supported on the frame for propelling the trenching apparatus along the pipeline including the thrusters having more axes of movement in the horizontal and vertical planes for impelling water entering the thruster out of the thrusters to generate any one of multiple forces applied to the trenching apparatus along a horizontal or vertical plane.

22 Claims, 4 Drawing Sheets

BUOYANT PROPULSION UNDERWATER TRENCHING APPARATUS

BACKGROUND OF THE INVENTION

This invention relates generally to a self-propelled underwater trenching apparatus. More particularly, the present invention is concerned with a self-propelled, underwater buoyant apparatus for burying pipelines or cables laid on the floor of a body of water.

Underwater trenching apparatus are well known in the art. These apparatus are typically used to bury either pipelines or cables under the floor of a body of water, such as across lakes, seas and oceans. Before the invention of underwater trenching apparatus, pipelines and cables were simply submersed under water and due to the high density of steel pipelines and cables, they sink to the bed of the sea.

The pipeline may be laid in a straight line and therefore presumed to remain in a uni-direction so that the trenching apparatus may easily follow and bury the pipeline but underwater current or other disturbances that may for instance be caused by storms vary the direction of the pipeline, often forming them into tight curves or even loops. Such abrupt changes in direction of the pipeline will not permit the apparatus to be steered quickly enough to the new direction and the water jets will tend to continue along the straight path to cut a straight rather than curved trench. The result is that the pipeline is not centerlined with the trench.

Even if the bottom is relatively level and the pipeline in a desired direction, obstacles often are found on the bottom that obstruct the forward movement of the apparatus as it is guided along the pipe. In most instances, the trenching apparatus known in the art requires a diver to be at hand if not riding upon the apparatus to remove such obstacles and prevent damage to the pipe or the apparatus. The requirement of the presence of the diver is not only added expense, but an inefficient method of detecting obstacles since the diver's vision is seriously limited by reason of the bottom cuttings being cast up upon the apparatus as well as the lack of light at the usual depth. A substantially self-sufficient trenching apparatus would avoid the frequency of diver inspection.

While guidance along the pipeline is logical and in most cases an effective method of directing the trenching apparatus, the pipeline is frequently not smooth, either due to cable slings permitted to remain on the line or because of various cathodic protection devices secured to the pipeline to prevent corrosion. These irregularities have in the past prevented guide rollers from passing over such irregularities. If the means of propulsion is a drive roller such drive roller often wears away the corrosion-resisting coating on the pipeline as it attempts to pass over the irregularity. In any event, the stoppage requires the immediate attention of the diver who usually must disassemble the apparatus from the pipe so that it can pass over the irregularity. Substantial loss in time and efficiency inherently occurs.

Numerous other problems arise in an effort to provide a self-propelled underwater trenching apparatus for burying pipeline and the like that requires the minimum amount of attention by the diver and maximum control in the supervising barge or ship. In order to provide a properly functioning trenching and burying apparatus having these characteristics, the attitude of the apparatus is of great importance to assure that it proceeds in the desired course. Means for effecting buoyancy and attempts to control the attitude of the apparatus have been utilized with limited success in the past.

Also of great importance is the requirement that no damage be caused to the pipeline or to its protective coating. When the apparatus is of great weight as is usually true of prior art apparatus, the pipeline and coating are frequently found to be scraped or marked. Lighter weight apparatus would be desirable provided they are capable of withstanding the very high pressures that may for instance exceed 1,000 psi.

DESCRIPTION OF PRIOR ART

There are many underwater trenching apparatus that have been commercially useful to both dig the trench and bury the pipelines. Among those apparatus in the prior art are the trenchers patented by Robert M. Norman, entitled Self-Propelled Underwater Trenching Apparatus and Method (U.S. Pat. No. 4,274,760), Buoyancy and Attitude Correction Method and Apparatus (U.S. Pat. No. 3,926,003), Oscillating Jet Head Underwater Trenching Apparatus (U.S. Pat. No. 4,389,139), Underwater Trenching Apparatus Guidance System (U.S. Pat. No. 3,877,237), and Buoyant Self-Propelled Underwater Trenching Apparatus (U.S. Pat. No. 4,087,981).

The Norman underwater trenching apparatus are all designed to be self-propelled along a pipeline by powered rollers maintained in rolling contact with the pipeline. Essentially, the pipeline serves as a rail-track allowing the underwater trenching apparatus to be guided to dig the trench properly beneath the pipeline. A drawback of such an arrangement is that the powered rollers abrade or otherwise damage the protective coating of the pipeline, thus, curtailing its life span.

As is well known to one skilled in the art, the weight of the apparatus exerts a force on the pipeline and there is a normal reaction force by the pipeline. To move the apparatus along the pipeline, the forces exerted longitudinally along the pipeline by the friction generated between the rollers and pipeline must be greater than the product of normal force and the coefficient of friction of the pipe surface.

On land, air friction is typically ignored because it does not play a significant role at low speeds. But under water, fluid fiction plays a significant role even at a low speed. Furthermore, when the pipeline forms a sharp turn or a loop by water currents, the normal force must be increased again to generate sufficient friction allowing the apparatus to be propelled forward. Inevitably, the enormous amount of friction and normal force exerted between the rollers and surface of the pipeline either abrades the pipeline coating, or deforms the shape of the pipeline, neither of which result is acceptable.

An early apparatus was patented by Urban A. Henry, Jr. entitled Underwater Pipeline-Burying Apparatus (U.S. Pat. No. 3,576,111). This apparatus is operable only when a diver is present serving as an operator. This invention is notably different from the Norman patents because the apparatus moves along the pipeline solely through thrusting nozzles and cutting nozzles instead of powered rollers. To move forward, thrusting nozzles generate a greater thrusting force than the reaction force of the cutting nozzles. While this invention does not erode the protective coating of the pipeline, it has numerous drawbacks. First, the apparatus can only be operated when an operator is present, which escalates the overall operating cost. Second, such a high pressure cutting environment is extremely dangerous to a human operator. Third, because the apparatus is operable only when a human operator is present, many safety precautionary features must be installed, again escalating the overall operating cost.

Johnson et al. discloses an invention entitled Embedding Cablelike Members (U.S. Pat. No. 4,812,079). Essentially, this invention plows a trench on the ocean floor for burying cables. The plow is a soil embedment depressor assembly. The plowing force comes from a winch being pulled against a fixture, such as a riverbank. Such advice would not be useful over large bodies of water to bury pipelines.

Saint E. Saxon discloses an invention entitled an Underwater Trenching System (U.S. Pat. No. 5,456,551). Since this invention also uses powered rollers on a pipeline, it has the same problem of abrading the pipeline protective coating as those of Norman patents.

Charles F. Martin discloses an invention entitled Underwater Trenching Apparatus (U.S. Pat. No. 4,516,880). This invention also contributes to abrading of pipeline protective coating by powered rollers. This invention teaches using two lateral fan thrusters in a weight control tank to provide lateral control.

Gerald G. Reuhl discloses an invention entitled Water Jet System for Trenching of Pipelines (U.S. Pat. No. 5,288,172). This invention does not use powered propelled rollers on the pipeline. Instead, it uses a plurality of traction cushion blocks connected together by an endless chain and driven by a rotating sprocket. The friction generated between the pipeline and the plurality of traction cushion blocks allows the water jet system to travel forward. Therefore, the same problem of eroding protective clothing exist.

John B. Lincoln discloses an invention entitled Apparatus and Method for Trenching Subsea Pipelines (U.S. Pat. No. 4,714,378). This apparatus is actually towed by a ship or barge through a cable. Water jet nozzles spray water under high pressure to form a trench in the sea bottom. Once hard rocks are encountered, mechanical cutters are used to continue trenching. This apparatus can also be retrofitted with self-propelling parts to travel along the pipeline on the seabed.

OBJECTS OF THE INVENTION

It is the principal object of the present invention to provide a self-propelled underwater trenching apparatus for burying pipelines, cables, and the like, which minimizes the requirement of the presence of the underwater supervision of the diver to enable effective and efficient operation of the trenching apparatus while being substantially completely controlled on the water surface.

An object of the present invention is the provision of multiple thrusters for propelling and positioning the trenching apparatus along the pipeline without the use of powered drive rollers that can abrade and destroy a pipeline coating.

A still further object of this invention is the provision of thrusters to assist in maneuvering the trenching apparatus along the pipeline while the trench is being dug and raise the apparatus to easily overcome obstructions on the pipeline.

A further object of the present invention is to provide positioning rollers for rolling contact with the pipeline for holding and for guiding the trenching apparatus on the pipeline.

Another object of the present invention is to use the thrusters to provide a directed back wash of the cuttings generated by the jet nozzles in forming the trench in order to maintain the trenched area clean of bottom cuttings until the trailing pipeline falls into the trench behind the trenching apparatus.

A further object of the present invention is to provide for resiliently urged rollers in order to accommodate various sizes of pipeline.

SUMMARY OF THE INVENTION

An underwater self-propelled trenching apparatus for burying a pipeline or the like below the bottom of a body of water having a frame that is positioned on each side of the pipeline, jets in the form of nozzles secured to the front of the frame on each side of the pipeline that spray pressurized streams of water to dig the trench, a set of rollers supported on the apparatus for contacting the pipeline and guiding the apparatus along the pipeline and a plurality of thrusters supported on said frame for propelling the trenching apparatus along the pipeline including thrusters having more than one axis of movement for impelling water entering said thruster out of said thrusters to generate any one of multiple forces applied to the trenching apparatus along a horizontal or vertical plane.

DESCRIPTION OF THE PREFERRED EMBODIMENT

Figure 1:
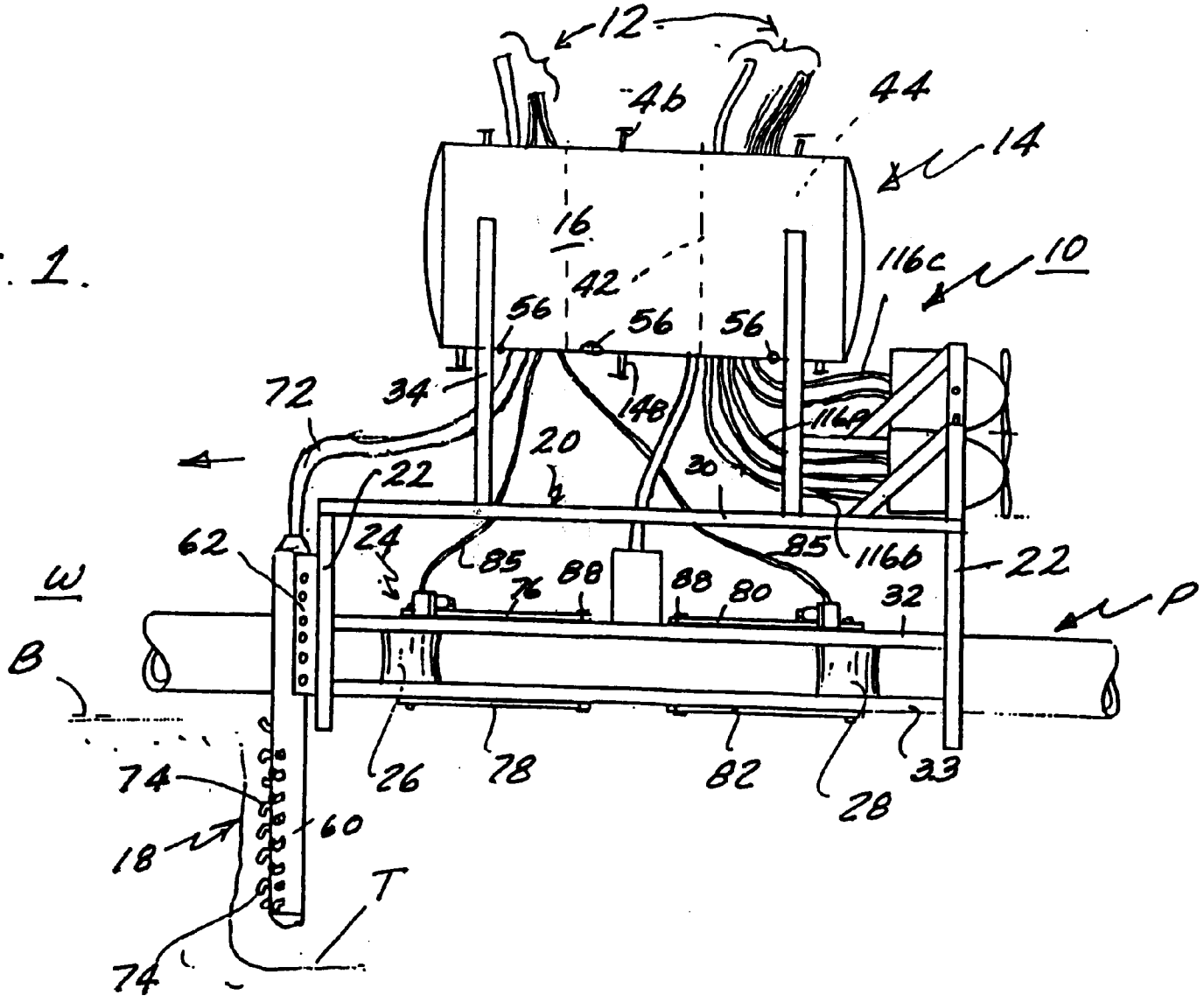
FIG. 1 is a schematic side elevation view of the self-propelled underwater trenching apparatus of the present invention illustrating the overall construction including the thrusters, the nozzles and the buoyancy tanks mounted on the frame with the attached hoses.
Figure 2:
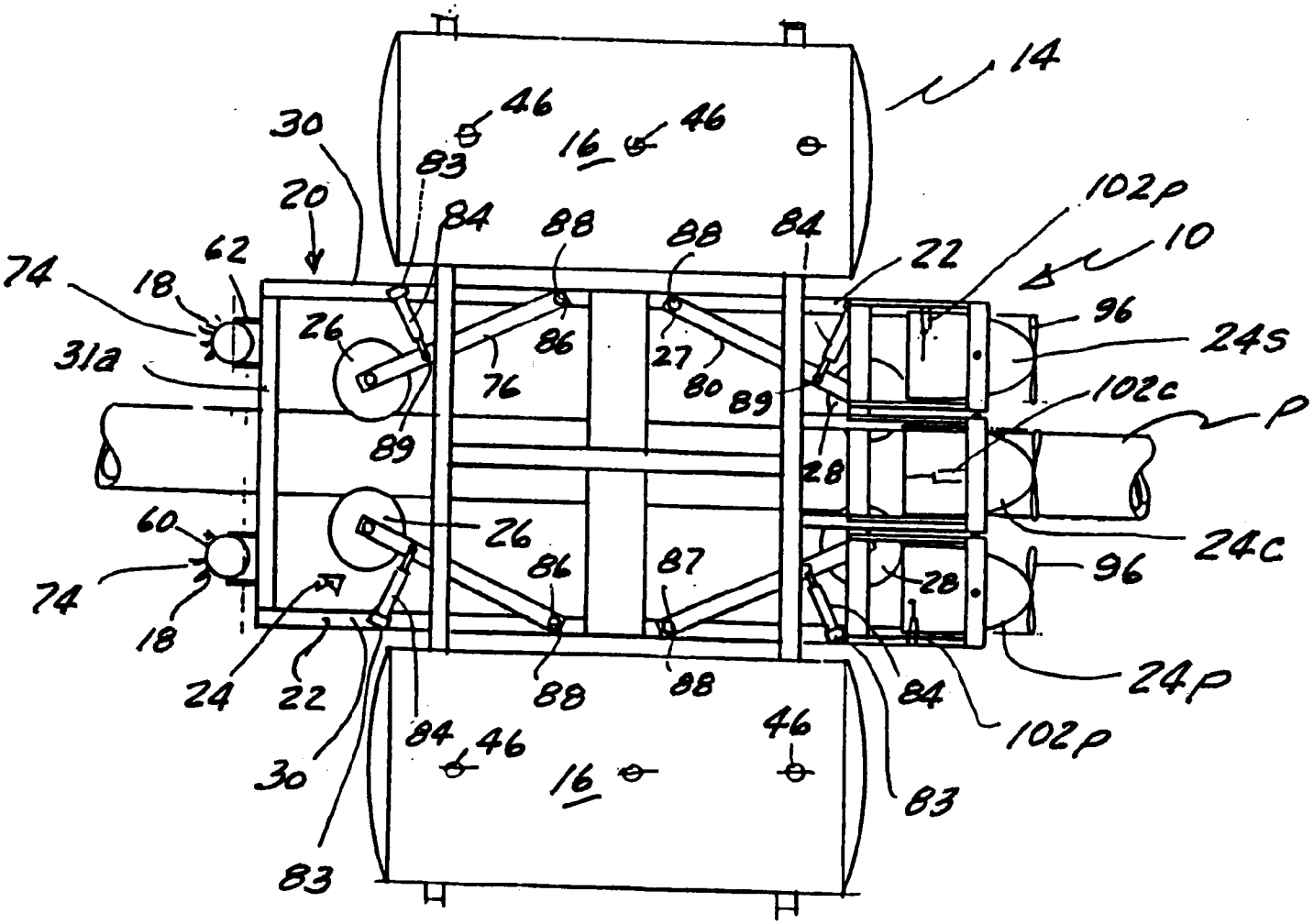
FIG. 2 is a plan view of the trenching apparatus of FIG. 1 illustrating more clearly the positioning of the thrusters and the guide rollers but omitting the hose bundle.
Figure 3:
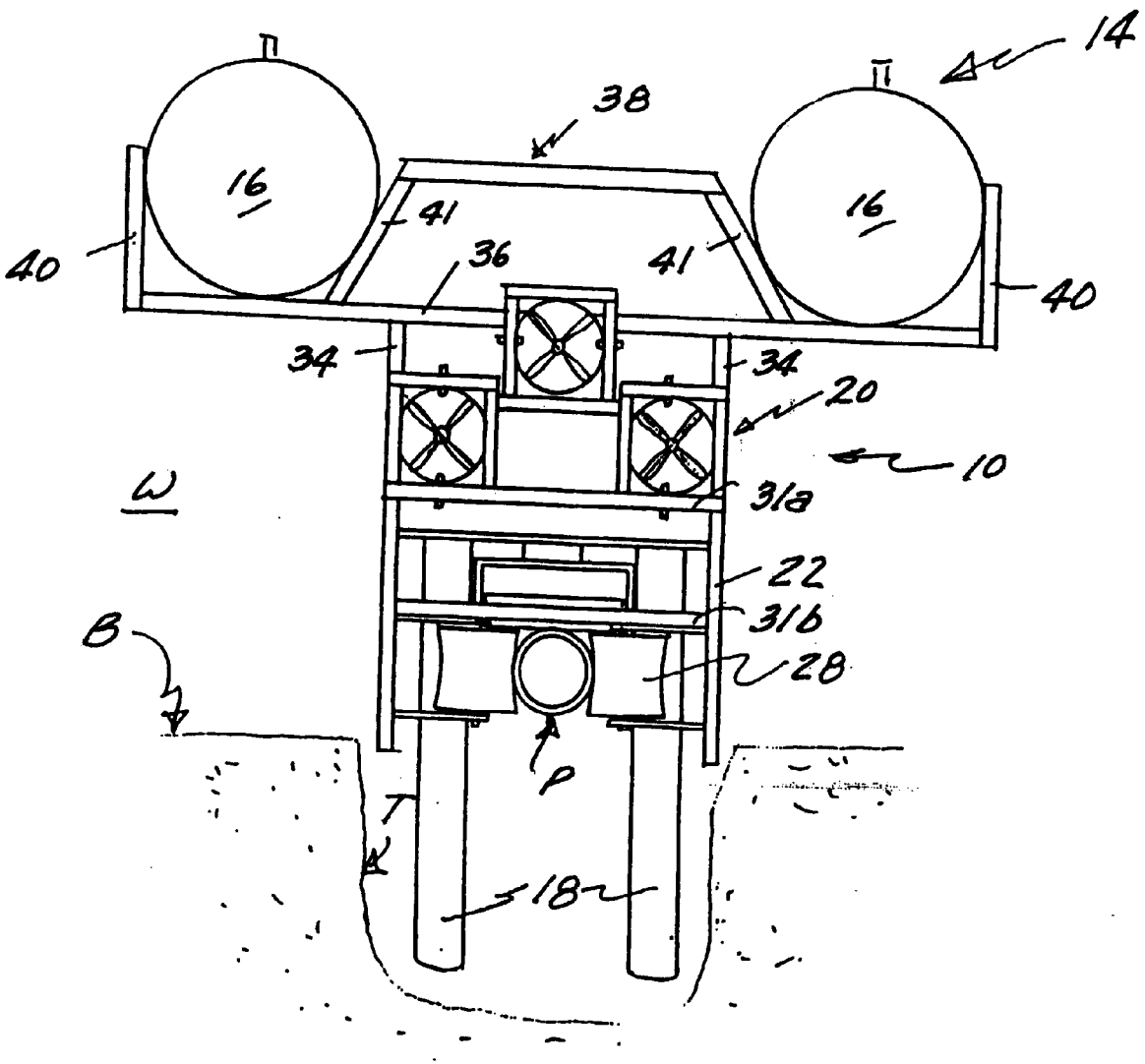
FIG. 3 is a stern view of the trenching apparatus of FIG. 2 illustrating positioning of the buoyancy tanks and the thrusters along with their axes providing the forces for directing the apparatus in any direction along the pipeline while the trench is being cut.

FIGS. 1, 2 and 3 of the drawing disclose generally the buoyant underwater self-propelled trenching apparatus 10 constituting the present invention. The apparatus is guided along pipeline P to be buried in the trench T formed by the apparatus. The apparatus 10 proceeds in the direction of the arrow shown in FIG. 1 along the pipeline P that has been previously laid on the bottom B of the body of water W. Connected to the apparatus 10 are various hoses 12 that may be in a bundle connected to pumping apparatus positioned on barge or ship, now shown on the surface of the water W.

Referring principally to drawings FIGS. 1, 2 and 3, the buoyant underwater self-propelled trenching apparatus of the present invention is composed of several elements. The buoyancy apparatus shown generally at 14 is composed of a pair of buoyancy tanks 16 that are identical. The apparatus surrounding the pipeline P includes jet means 18, for cutting the trench T, positioned on either side of the pipe and secured towards the forward end of the apparatus onto frame 20 composed of steel tubular members 22. Propulsion of the apparatus 10 is achieved from thruster assembly 24 comprising a plurality of thrusters that are pivotally secured to the frame. Forward and rearward guide rollers means 26 and 28 are also secured to the frame and positioned to be in contact with the pipeline P to enable the apparatus 10 to be sensitive to changes in direction of the pipeline P and shift the apparatus accordingly.

Frame Structure

The structure of the trenching apparatus 10 is composed basically of a frame 20 formed from inverted U-shaped sealed square steel tubing 22 positioned fore and aft on the apparatus. Joined at the U are a pair of parallel longitudinal square tubular members 30 to be positioned on each side of the pipeline P in working position as may be seen in FIG. 2 and supported by pairs of cross beams 31*a* and 31*b*. At the bottom of the legs of the U lower longitudinal members 32 and 33 similar to 30 are secured. Mounted on top of the frame 20 are vertical supporting members 34 which are four in number and which are supported on cross struts 36 shown in FIG. 5. Supported on the members 34 is an outrigger carriage 38 to which are attached the buoyancy tanks 16 being held in place by cradle struts 40 and 41 securing each of the buoyancy tanks to the side of the apparatus 10 as best shown in FIG. 3.

Buoyancy and Attitude Correction Mechanism

The buoyancy tanks 16 are made of rigid material and are compartmented by partition 42 into three separate non-communicating compartments 44. The level of the water in each compartment is controlled by air outlet valves 46 at the top of the buoyancy tank and air inlet valves 48 positioned in the bottom of the tanks and connected by suitable hose, not shown. Also at the bottom of each tank is an opening 56 which permits water to enter and be discharged in accordance with the operation of the air pressure supplied by the air inlet valves 48 and air outlet valves 46.

The compartments in each of the tanks will readily fill with water upon submersion of the apparatus provided the air outlet valves 46 are open. After the compartments or any one of them are filled there would be no buoyant effect from that compartment until water is pumped out of any one of the compartments. Since there are provided tanks on either side of the pipe P and the tanks are positioned on the vertical centerline of the apparatus as best shown in FIG. 2, it should be obvious that the attitude of the apparatus can be varied in accordance with the amount of air in any one of the compartments. By emptying the forward compartments in both of the tanks the apparatus is tilted upwardly. As will be set forth subsequently, the upward tilt in combination with the pivoting of the central thruster will aid in raising the apparatus to overcome obstacles on the pipeline. By unbalancing the buoyant effect on either the left or the right buoyancy tank the attitude of the apparatus may be tilted to the left or to the right in a manner that should be obvious.

The Formation Cutting Jet Means

The jet means 18 on either side of the pipeline P as may be best seen in FIGS. 2 and 3 is formed from high pressure steel tubing 60 to form a cutting head. To the cutting head is welded a multiholed bolting frame or fishback 62 secured as by welding to tubular member 22 of the frame 20. As shown in FIG. 1, the cutting tube 60 fluidly communicates with high pressure water hose 72. It has been found to be desirable to provide each cutting tube 60 with its own water hose 72.

The forward face of the cutting tube 60 forming the jet means 18 is provided with a plurality of jet nozzles 74. Each of the jet nozzles may be provided with various angles that may range from 30°–90°. The nozzles 74 are suitably secured to nozzle adaptors that communicate to the interior of the tube 60.

As best shown in FIG. 2, the nozzles 74 are positioned on the tube 60 in three vertical rows being radially positioned around the tube 60 at an angle of 20°–50° from each other. To minimize the rearward thrust provided by the reaction to the water jetting from the jet nozzles 74, each nozzle is positioned to offset as much as possible the tilting, turning or reverse thrust produced by the jet nozzles. For every nozzle that is pointed at any particular angle downwardly or upwardly and inwardly or outwardly relative to the centerline of the pipeline there is a complementary jet nozzle 74 on the opposite tubular member 60 to offset the torquing effect. The nozzles are also directed to avoid direct contact of the water jets with the pipe.

Roller Guidance System

To guide the apparatus 10 down the pipeline a forward pair of rollers 26 and aft pair of rollers 28 are secured to the frame 20. Both of these pairs of rollers are resiliently mounted for rotation at the end of upper and lower arms 76 and 78 for the forward pair of rollers 26, 26, and upper and lower arms 80 and 82 for the aft pair of rollers 28, 28. These arms are pivotally mounted at 86 and 87 by pivot pins 88 passing through the upper and lower arms and upper and lower longitudinal members 32 and 33, as best shown in FIG. 1. Suitable bearing surfaces, not shown, are provided between the arms and the upper and lower longitudinal members. The rollers 26 and 28 are mounted at the ends of upper and lower arms 76, 78 and 80 and 82 respectively also with suitable bearings, not shown.

The present invention also includes resilient means 84 that may be in the form of a fluid-actuated shock absorber, ram or any other resilient means such as a spring. As shown, the shock absorber 84 is hydraulically activated and is pivotally secured at one end 83 to the inner side of the longitudinal member 32. The resilient member 84 then extends inwardly towards the pipeline P and is received by each one of the upper arms 76 and 80 at pivot points 89. The amount of pressure provided by the rollers 26 and 28 upon the pipe P may be simply adjusted in accordance with the pipe diameter or other purposes by simply adjusting the hydraulic fluid pressure applied to the resilient member 84 in any conventional manner as by hoses 85 in which the hydraulics are controlled on the water surface. Also pressure gauges or other pressure sensitive means may be incorporated in the shock absorber to detect pressure variations to not only maintain the desired pressure of the rollers on the pipeline but also to detect obstructions on the surface of the pipeline, for example anodes etc. that the present trenching apparatus should, if the obstructions are minor, override.

Thus by the rollers 26 and 28 being in controlled pressured contact with the pipeline P, any curvature of the pipeline will be followed by the rollers and therefore the trenching apparatus as it proceeds down the pipeline.

Propulsion and Direction System

Figure 4:
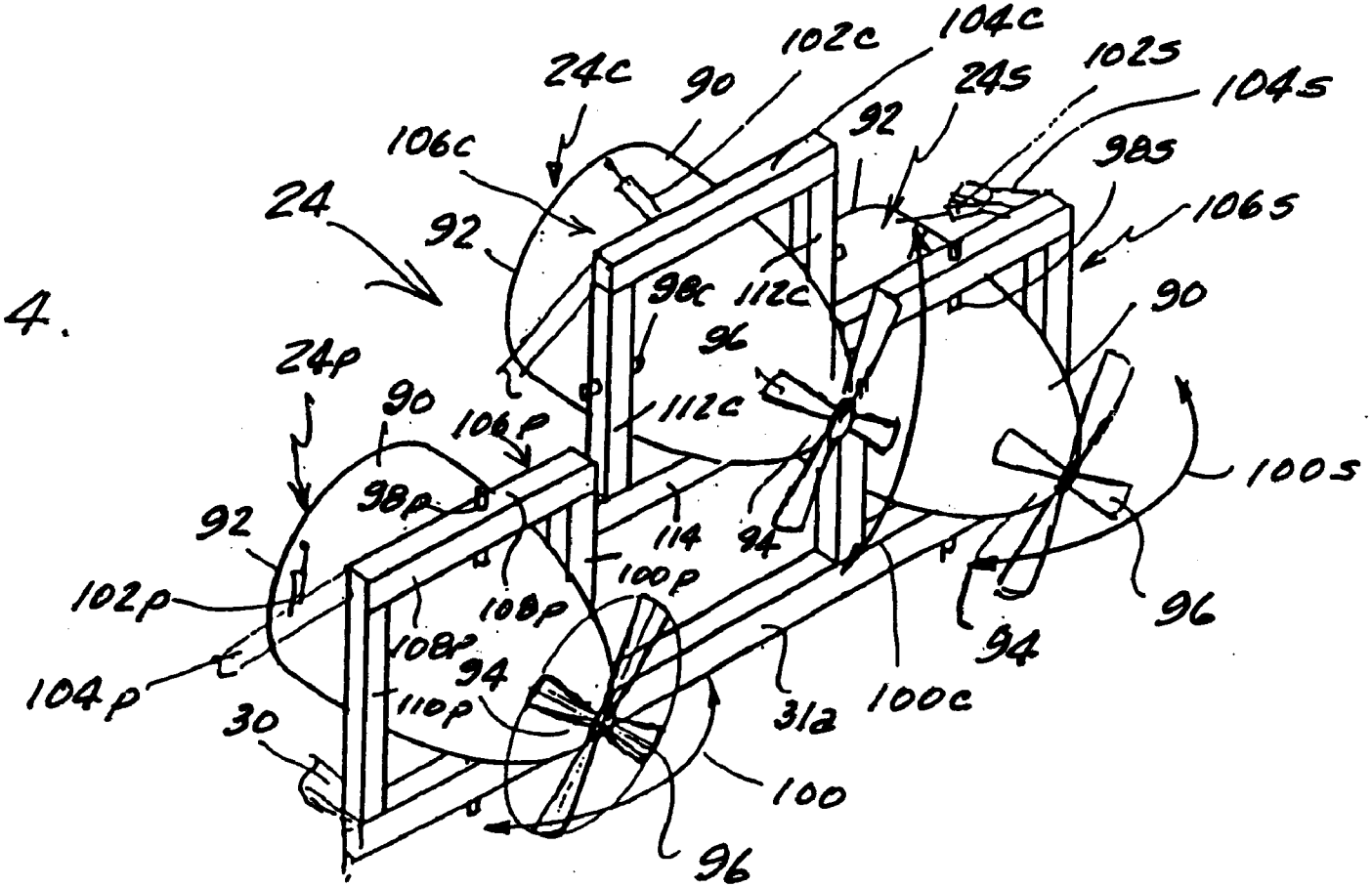
FIG. 4 is a schematic view in perspective partly broken away illustrating the thrusters with propellers and axes for movement of each thruster.

The sole propulsion for the trenching apparatus is a thruster assembly 24 as best shown in FIG. 4. This thruster assembly has a number of individual thrusters preferably as shown three in number, 24*p* on the port side, 24*s* on the starboard side and 24*c* centrally located on the longitudinal axis of the trenching apparatus. Each thruster is preferably provided with a surrounding hood 90 that may be ellipsoid in longitudinal cross section having an opening 92 projecting forward. At the end 94 of each thruster 24*p*, 24*s* and 24*c* there is provided a propeller 96 suitably journalled therein.

An important aspect of the present invention is the provision of various pivot axes: 98*p* for thruster 24*p*; 98*s* for thruster 24*s* and 98*c* for thruster 24*c*. These axes permit their respective thruster to swing in the direction of arrows 100*p*, 100*s* and 100*c*. Thus each of the port and starboard thrusters 24*p* and 24*s* are permitted to swing almost 180° in a horizontal plane while thruster 24*c* may swing almost 180° in a vertical direction. Suitable hydraulic rams 102*p*, 102*s* and 102*c*, controllable at the water surface are secured to the inclined frame members 104*p* and 104*s* and horizontal top central member 104*c* as best shown in FIG. 4.

The axes 98*p*, 98*s* and 98*c* are supported in tubular boxes 106*p*, 106*s* and 106*c* which in turn are supported on frame cross member 31*a*. Tubular box 106*p* is formed by horizontal upper member 108*p* and two vertical side members 110*p*. Axis 98*p* is thus journalled in upper member 108*p* and also in cross member 31*a*. Similarly, axis 106*s* is journalled in upper cross member 108*s* and frame cross member 31*a*.

The centrally located thruster 24*c* is provided with tubular box 106*c* formed by vertical central members 112*c* on each side of the thruster 24*c*. These vertical central members 112*c* are supported by central horizontal bottom central members 114. Thus, as shown in FIG. 4 thruster 24*c* is journalled on each side into vertical central members 112*c*.

The thruster assembly 24 is powered preferably by suitable conventional hydraulic motors secured within each hood 90. Hydraulic hoses 116*p*, 116*s* and 116*c*, as shown in FIG. 1 only, supply the necessary fluid selectively to power the thrusters by controls, not shown, at the water surface. Thus directing more or less pressure to either thruster 24*p* or 24*s* will turn and positively direct the trenching apparatus in the direction desired in the same manner as with a twin screw marine vessel.

The thruster 24*c* however provides a very different capability. Should an obstruction in the pipeline P be encountered, the thruster 24*c* may be tilted upwardly (with propeller 96 downwardly) by the withdrawing action of ram 102*c*. The thrust of the propeller 96 will thus raise the entire trenching apparatus up over the obstruction. Also such positioning of thruster 24*c* would aid in raising the trenching apparatus to the water surface, if desired because of storm, bad seas, etc. The buoyancy tanks, as previously stated, may if desired aid in changing the attitude of the trenching apparatus 10 to assist in raising the apparatus over obstructions or to raise the apparatus to the surface.

Hose Bundle

The hoses 12 connected from the ship and passed down to the apparatus 10 require at least two water hoses, several hydraulic hoses and possibly one air hose (not shown), which may be used to aid in raising cuttings from the nozzles out of the truck and to provide if desired buoyancy to the hose bundle 12. Usually, in the practice of this invention, not only are separate water hoses 72 provided for the cutting heads 60, but also separate hydraulic hoses 116*p*, 116*s* and 116*c* are required to supply fluid to each of the thrusters.

The water hose pressure for the cutting heads 60 is usually above 1000 psi. If the air hose is tied to the hoses 72 and 116 to form a bundle and the air hose is of sufficient size to float all the hoses as shown in FIG. 1 there is no need to utilize the usual buoy or crane to hold the bundles upwardly. The size of an air hose in relationship to the sizes of the water hoses depends upon the number of water hoses in the hose bundle. The only requirement is that the air hose be of sufficient size to make the hose bundle buoyant. As examples of the air hose diameter, one 4 inches in diameter air hose will provide sufficient buoyant force to float three high pressure water hoses of up to 2½ inches in diameter.

It should be manifest that the apparatus 10 can be quickly and easily set up for self-propelled motion and left unattended. The buoyancy from tanks 16 would be adjusted to produce minimum pressure upon the pipeline from the weight of the apparatus. The thruster assembly 24 will move the apparatus along the pipeline until some fouling occurs. Only if there is an increase in the pressure sensed by shock absorbers 84 indicating an obstruction would it be necessary to impart an upward force by the action of thruster 24*c* to rise up and over the obstruction. In such a case unlike the prior art apparatus, no diver would be used to inspect the condition.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. An underwater trenching apparatus for burying a pipeline or cables beneath the bottom of a body of water comprising:

a frame for positioning over the pipeline to be buried, jet means supported by said frame, comprising a plurality of vertically arranged nozzles for digging a trench in said bottom for burying said pipeline, a set of rollers secured to said apparatus and adapted to contact said pipeline to direct said apparatus along said pipeline, a plurality of hydraulic thrusters for receiving water therein and having means thereon to expel this water to provide a force reactive to the force of said expelled water, said thrusters including support means capable to direct the expelled water from a selected thruster in a selected direction and generate and apply a reactive force to the trenching apparatus in a selected direction within a vertical and horizontal plane.

2. The apparatus of claim 1 including, at least one ballast tank supported on said frame.

3. The apparatus of claim 2 including, said at least one ballast tank adapted to be positioned on each side of said pipeline.

4. The apparatus of claim 1 including, resilient means positioned on said frame for urging said rollers into engagement with said pipeline.

5. The apparatus of claim 1 including, said rollers being rotatably mounted on an arm pivotally secured to said frame.

6. The apparatus of claim 1 including, resilient means positioned on an arm pivotally secured to said frame for urging said rollers into engagement with said pipeline.

7. The apparatus of claim 1 including, at least one ballast tank supported on said frame, said at least one ballast tank being positioned on each side of said pipeline, and resilient means positioned on said frame for urging said rollers into engagement with said pipeline.

8. The apparatus of claim 1 including, resilient means positioned on said frame for urging said rollers into engagement with said pipeline, and said rollers being rotatably mounted on an arm pivotally secured to said frame.

9. The apparatus of claim 1 including, at least one ballast tank supported on said frame, said at least one ballast tank being positioned one ach side of said pipeline, and resilient means positioned on an arm pivotally secured to said frame for urging said rollers into engagement with said pipeline.

10. The apparatus of claim 1 including, said thrusters including pivot means thereon to permit selected thrusters to pivot about a selected axis in one of a vertical and horizontal plane.

11. The apparatus of claim 1 including, said thrusters including propeller blades to expel water received therein.

12. The apparatus of claim 1 including, said plurality of thrusters including a central thruster and a pair of side thrusters.

13. The apparatus of claim 12 including, said central thruster being mounted to said frame on a horizontal axis to permit said thruster to apply an upwardly directed force to raise said trenching apparatus relative to said pipeline.

14. The apparatus of claim 12 including, said side thrusters being mounted to said frame on vertical axes to permit said thruster to apply a sidewise force to said trenching apparatus for directing said apparatus along said pipeline.

15. The apparatus of claim 1 including, said thrusters including pivot means thereon to permit selected thrusters to pivot about a selected axis in one of a vertical and horizontal plane, and said thrusters including propeller blades to expel water received therein.

16. The apparatus of claim 1 including, said plurality of thrusters including a central thruster and a pair of side thrusters, and said central thruster being mounted to said frame on a horizontal axis to permit said thruster to apply an upwardly directed force to raise said trenching apparatus relative to said pipeline.

17. The apparatus of claim 1 including, said plurality of thrusters including a central thruster and a pair of side thrusters, said central thruster being mounted to said frame on a horizontal axis to permit said thruster to apply an upwardly directed force to raise said trenching apparatus relative to said pipeline, and said side thrusters being mounted to said frame or vertical axes to permit said thruster to apply a sidewise force to said trenching apparatus for directing said apparatus along said pipeline.

18. The apparatus of claim 1 including, said thrusters including pivot means thereon to permit selected thrusted to pivot about a selected axis in one of a vertical and horizontal plane, said thrusters including propeller blades to expel water received therein, and said plurality of thrusters including a central thruster and a pair of side thrusters.

19. The apparatus of claim 1 including, said thrusters including pivot means thereon to permit selected thrusters to pivot about a selected axis in one of a vertical and horizontal plane, and said plurality of thrusters including a central thruster and a pair of side thrusters.

20. The apparatus of claim 1 including, said thrusters including pivot means thereon to permit selected thrusters to pivot about a selected axis in one of a vertical and horizontal plane, said plurality of thrusters including a central thruster and a pair of side thrusters, and said central thruster being mounted to said frame on a horizontal axis to permit said thruster to apply an upwardly directed force to raise said trenching apparatus relative to said pipeline.

21. The apparatus of claim 1 including, said thrusters including pivot means thereon to permit selected thrusters to pivot about a selected axis in one of a vertical and horizontal plane, said plurality of thrusters including a central thruster and a pair of side thrusters, said central thruster being mounted to said frame on a horizontal axis to permit said thruster to apply an upwardly directed force to raise said trenching apparatus relative to said pipeline, and said side thrusters being mounted to said frame or vertical axes to permit said thruster to apply a sidewise force to said trenching apparatus for directing said apparatus along said pipeline.

22. The apparatus of claim 1 wherein:

each of said thrusters providing the sole forward propulsive force for said apparatus along said pipeline.

* * * * *